US011309156B2

(12) United States Patent
Spritzendorfer et al.

(10) Patent No.: US 11,309,156 B2
(45) Date of Patent: Apr. 19, 2022

(54) OPERATING ATTACHMENT

(71) Applicant: Eaton Intelligent Power Limited, Dublin (IE)

(72) Inventors: Bernd Spritzendorfer, Urschendorf (AT); Raffael Zimmel, Tulln (AT)

(73) Assignee: Eaton Intelligent Power Limited, Dublin (IE)

( * ) Notice: Subject to any disclaimer, the term of this patent is extended or adjusted under 35 U.S.C. 154(b) by 150 days.

(21) Appl. No.: 16/649,668

(22) PCT Filed: Sep. 25, 2018

(86) PCT No.: PCT/EP2018/075855
§ 371 (c)(1),
(2) Date: Mar. 23, 2020

(87) PCT Pub. No.: WO2019/063501
PCT Pub. Date: Apr. 4, 2019

(65) Prior Publication Data

US 2020/0303149 A1 Sep. 24, 2020

(30) Foreign Application Priority Data

Sep. 26, 2017 (DE) ..... 10 2017 122 219.7

(51) Int. Cl.
*H01H 71/50* (2006.01)
*H01H 71/56* (2006.01)

(52) U.S. Cl.
CPC ..... *H01H 71/501* (2013.01); *H01H 71/56* (2013.01)

(58) Field of Classification Search
CPC ..... H01H 71/501; H01H 71/56; H01H 3/42; H01H 2071/565; H01H 71/50
(Continued)

(56) References Cited

U.S. PATENT DOCUMENTS 2,849,581 A * 8/1958 Bingenheimer ..... H01H 71/501 200/DIG. 42
5,302,925 A * 4/1994 Castonguay ..... H01H 71/501 200/43.14
9,396,886 B2 * 7/2016 Reinhart ..... H01H 9/04

FOREIGN PATENT DOCUMENTS

DE 210783 A 6/1984
DE 3545843 A1 * 6/1987 ..... H01H 11/0018
EP 2500925 A1 9/2012

* cited by examiner

*Primary Examiner* — Scott Bauer
*Assistant Examiner* — Sreeya Sreevatsa
(74) *Attorney, Agent, or Firm* — Leydig, Voit & Mayer, Ltd.

(57) ABSTRACT

An operating attachment for arrangement on a predefinable switching device and for operating a pivotable switching device toggle of the switching device includes: a one-sided open housing positionable on the switching device; a rotatable shaft having a rotation axis; a manual operating part, the manual operating part being situated on the rotatable shaft; a switch-on projection for pivoting the switching device toggle in a first pivot direction, the switch-on projection being situated on the rotatable shaft; a switch-off projection for pivoting the switching device toggle in a second pivot direction opposite the first pivot direction, the switch-off projection being situated on the rotatable shaft; and a housing stop for contacting a stop edge of the switch-off projection, the housing stop being situated in the one-sided open housing. The switch-off projection yields resiliently such that the switch-off projection is bent for contact with the housing stop.

8 Claims, 2 Drawing Sheets

(58) Field of Classification Search
USPC ..... 335/172
See application file for complete search history.

OPERATING ATTACHMENT

CROSS-REFERENCE TO PRIOR APPLICATIONS

This application is a U.S. National Phase application under 35 U.S.C. § 371 of International Application No. PCT/EP2018/075855, filed on Sep. 25, 2018, and claims benefit to German Patent Application No. DE 10 2017 122 219.7, filed on Sep. 26, 2017. The International Application was published in German on Apr. 4, 2019 as WO/2019/063501 under PCT Article 21(2).

FIELD

The invention relates to an operating attachment.

BACKGROUND

Prior art is familiar with so-called operating attachments that can be arranged on the front of a switching device that faces a user or a switch cabinet door.

One purpose of such an operating attachment is to intentionally alter the manner in which the switching device is operated. Such an operating attachment makes it possible to change the pivot direction for the operation of a toggle of a switching device into a rotation movement. This sometimes accommodates the habits of a user. What is important here, however, is that a larger rotary handle, which is easier to use with a glove when it is cold, is used. This makes it possible to prevent wrong switches of a switching device, for example due to the limited motor ranges of the user.

Another purpose of such an operating attachment is that it makes it possible to increase the distance from the actual switching device. Such an operating attachment is frequently used, for example, in the field of photovoltaic systems in which voltages of 1000 V are not uncommon and where safety distances from the switching devices are necessary.

It may happen that the switching contacts of a switching device fuse together. As a result, the contacts are not separated even when such a defective switching device is turned off or disengaged, and current continues to continue to flow through the switching device. A corresponding switching toggle of such a switching device therefore remains in a position situated between the ON and the OFF position.

It has been found that there are operating attachments in which it is possible to rotate the rotary knob, even in a switching device with fused contacts, so far in the direction of the OFF position of the rotary knob of the operating attachment that the same would temporarily remain in this position without any application of force but could be fastened in place, for example with a wire. This, however, gives the impression of a switching device that is turned off. The structure of such a switching device is not without current, however, and constitutes a significant risk. No protection is provided either because the respective switching device or protective device is already defective.

SUMMARY

In an embodiment, the present invention provides an operating attachment for arrangement on a predefinable switching device and for operating a pivotable switching device toggle of the switching device, the operating attachment comprising: a one-sided open housing positionable on the switching device; a rotatable shaft having a rotation axis; a manual operating part, the manual operating part being situated on the rotatable shaft; a switch-on projection configured to pivot the switching device toggle in a first pivot direction, the switch-on projection being situated on the rotatable shaft; a switch-off projection configured to pivot the switching device toggle in a second pivot direction opposite the first pivot direction, the switch-off projection being situated on the rotatable shaft; and a housing stop configured to contact a stop edge of the switch-off projection, the housing stop being situated in the one-sided open housing, wherein the switch-off projection is configured to yield resiliently such that the switch-off projection is bent for contact with the housing stop on the one-sided open housing when loaded with a predefinable first force which acts in a direction of the manual operating part and parallel to the rotation axis of the rotatable shaft.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 4:
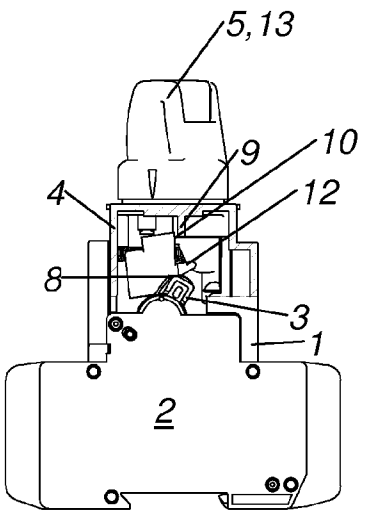
FIG. 4 shows the system according to FIG. 1 with the switching device with fused contacts, wherein the switch-off projection is bent, and the stop edge is in contact with the housing stop.

In an embodiment, the present invention provides an operating attachment of the type described above in which the stated disadvantages can be avoided, with which it can be ensured that the rotary knob cannot be locked in the OFF position when the switching contacts of the switching device are fused, and which has a simple design.

This makes it possible to ensure that the rotary knob cannot be locked in the OFF position when the switch contacts of the switching device are fused. Furthermore, such an operating attachment has a simple design.

FIGS. 1 to 4 show a system comprising a switching device 2, in particular a protective switch or a load-break switch, and an operating attachment 1 for arrangement on a predefinable switching device 2 and for operating a pivotable switching device toggle 3 of the switching device 2, wherein the operating attachment 1 has a one-sided open housing 4 for situating the same on the switching device 2, wherein the operating attachment 1 of a manual operating part 13 is situated on a rotatable shaft 6 of the operating attachment 1, wherein a switch-on projection 7 for pivoting the switching device toggle 3 in a first pivot direction is situated on the shaft 6, wherein a switch-off projection 8 for pivoting the switching device toggle 3 in a second pivot direction opposite the first pivot direction is situated on the shaft 6, wherein a housing stop 9 for contact with a stop edge 10 of the switch-off projection is situated in the housing 4, and wherein the switch-off projection 8 is designed to yield resiliently such that it is bent for contact with the housing stop 9 on the housing when loaded with a predefinable first force which acts in the direction of the manual operating part 13 and parallel to the rotation axis of the shaft 6.

This makes it possible to ensure with respect to an operating attachment 1 that the rotary knob 5 cannot be brought into the off position and/or locked there when the switch contacts of the switching device 2 are fused. Furthermore, such an operating attachment 1 has a simple design.

The operating attachment 1 in question is intended and accordingly configured for being arranged on a predefinable switching device 2 and for operating this switching device 2 in the sense that a manual operating part of the respective switching device 2, which may be a switching device toggle 3, is moved to switch the switching device 2 on or off. Since switching devices 2 may have different dimensions, a specific type of an operating attachment 1 is provided to be situated on a specific switch 2 and configured with respect to the dimensions of that switch. The operating attachment 1 is provided for operating a pivotable switching device toggle 3 of the switching device 2.

The operating attachment 1 comprises a one-sided open housing 4 to be situated on the switching device 2, which is configured in particular as a housing made from insulating material, wherein furthermore means for attaching the housing 4 at the front of the switching device 2 are provided. Preferably, the attachment means are configured as a click-on or snap-on connection and/or as a tongue-and-groove connection, wherein corresponding protrusions or recesses are formed on the switching device 2 and the operating attachment 1. The attachment means may, however, be designed differently and may comprise screws or use one or more bayonet catches.

The fastening attachment 1 comprises a manual operating part 13 with said manual operating part 13 being arranged on or fastened to a rotatable shaft 6 of the operating attachment 1. The manual operating part 13 may be designed, for example, as a rotary handle or lever. It is particularly preferable if the manual operating part 13 is designed as a rotary knob 5 as shown in FIGS. 1 to 4 as well.

A switch-on protrusion 7 is arranged on a shaft 6 arranged at the inside of the one-sided open housing 4, which passes through a front wall of the housing 4 for pivoting the switching device toggle 3 in a first pivot direction.

Furthermore, a switch-off protrusion 8 is arranged in said region of the shaft 6 for pivoting the switching device toggle 3 in a second pivot direction which is opposite the first pivot direction.

Due to the shaft 6, the switch-on projection 7 and the switch-off projection 8 are rotated as well when the rotary knob 5 is rotated. This rotation then actuates the switching device toggle 3 by means of a tangentially acting force.

A housing stop 9 is arranged in the housing 4. Said stop is preferably formed as a bar that protrudes into the housing 4, as shown, for example, in FIGS. 1 to 4. The housing stop 9 is provided for contact with a stop edge 10 of the switch-off projection 8 and therefore reaches far into the interior of the housing 4 and/or the stop edge 10 reaches accordingly far into the housing 4.

The switch-off projection 8 is designed to yield resiliently such that it is bent for contact with the housing stop 9 on the housing when loaded with a predefinable first force which acts in the direction of the manual operating part 13 in the direction of the rotary knob 5 and parallel to the rotation axis of the shaft 6. This first force is generated by the attempt to bring the rotary knob 5 into the off position when the contacts of the switching device 2 have fused by precisely this torque acting on the rotary knob 5. Since the contacts have fused, the switching device toggle 3 remains in a position shortly before the off position and cannot be moved any further. In the attempt to move the same, the switch-off projection 8 comes in contact with the switching device toggle 3, which has already assumed a position that is transverse from the shaft 6. According to the action=reaction principle, this generates a force, which, due to the transverse surface, comprises a force component which has a line of action substantially parallel to the shaft 6 as well as a direction toward the rotary knob 5.

Figure 3:
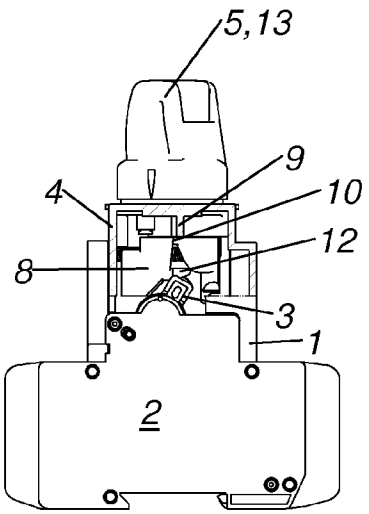
FIG. 3 shows the system according to FIG. 1 with the switching device having fused contacts and the rotary knob of the operating attachment shortly before the bending of the switch-off projection.
Figure 2:
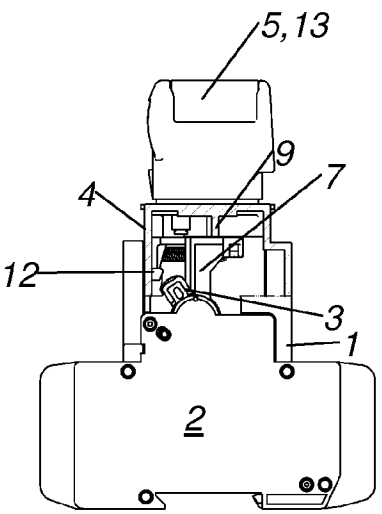
FIG. 2 shows the system according to FIG. 1 with the switching device and the operating attachment in the ON position.
Figure 1:
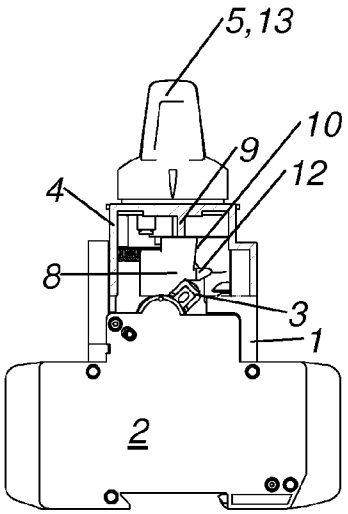
FIG. 1 shows a system comprising a switching device and an opened operating attachment in the drilldown with the switching device and the operating attachment in the OFF position.
Figure 8:
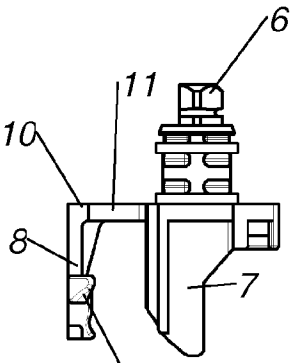
FIG. 8 shows the embodiment according to FIG. 5 in a fourth side view.
Figure 7:
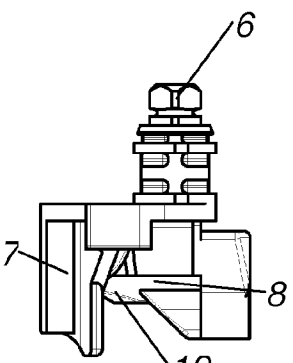
FIG. 7 shows the embodiment according to FIG. 5 in a third side view.
Figure 9:
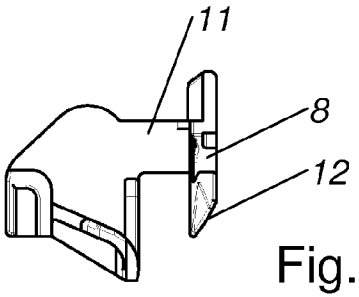
FIG. 9 shows the embodiment according to FIG. 5 from a bottom view of the second side view.
Figure 6:
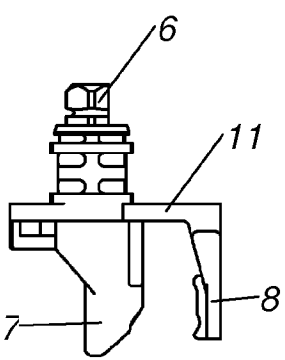
FIG. 6 shows the embodiment according to FIG. 5 in a second side view.
Figure 10:
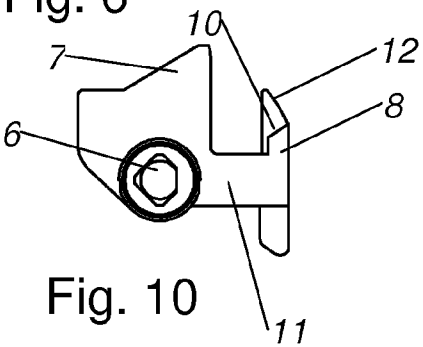
FIG. 10 shows the embodiment according to FIG. 5 from a top view of the second side view.
Figure 5:
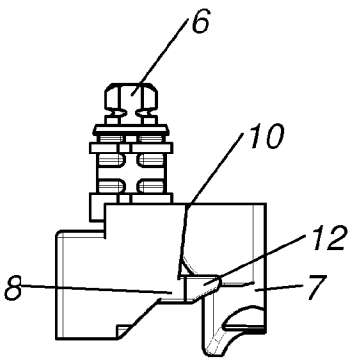
FIG. 5 shows a preferred embodiment of an integrally formed switch-on/switch-off projection in a first side view.

FIGS. 1 and 2 show the switching device 2 as well as the operating attachment 1 in the operational states switched off and switched on. FIG. 3 shows the switching device 2 with fused contacts and makes very clear that the switching device toggle 3 stays in a position before the off position. FIG. 4 shows the locked state, wherein the stop edge of the switch-off projection 8 is pushed high against the housing stop 9 and wherein any further rotation of the rotary knob 5 is prevented by the direct contact.

It is especially advantageous if the switch-off projection 8 comprises a switching device toggle operation region 12 and if the switching device toggle operation region 12 is transverse so as to support the first force in the operation of the switching device toggle 3. This way, the generation of a corresponding force as well as the "sliding" of the switch-off projection 8 are supported by means of the switching device toggle 3.

Preferably, the switch-off projection 8 is connected with the shaft 6 by means of a connecting region 11, and the connecting region 11 is designed so that it can yield resiliently. This makes it possible to reach a good rigidity in the direction of rotation with, at the same time, a good flexibility or bendability in the direction of the housing stop 9.

Preferably, the switch-off projection 8 and the switch-on projection 7 are integrally formed. FIGS. 5 to 10 show such an integrally formed unit comprising the switch-off projection 8 and the switch-on projection 7.

It is especially preferred if the switch-off projection 8 and/or the connecting region 11 are made from a plastic with which both the bendability can be achieved and any insulation problems avoided.

It is furthermore provided that the predefinable bending of the switch-off projection 8 is reversible. This can easy be achieved by selecting a suitable plastic.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. An operating attachment for arrangement on a predefinable switching device and for operating a pivotable switching device toggle of the predefinable switching device, the operating attachment comprising:

a one-sided open housing positionable on the predefinable switching device;

a rotatable shaft having a rotation axis;

a manual operating part, the manual operating part being situated on the rotatable shaft;

a switch-on projection configured to pivot the pivotable switching device toggle in a first pivot direction, the switch-on projection being situated on the rotatable shaft;

a switch-off projection configured to pivot the pivotable switching device toggle in a second pivot direction opposite the first pivot direction, the switch-off projection being situated on the rotatable shaft; and a housing stop configured to contact a stop edge of the switch-off projection, the housing stop being situated in the one-sided open housing, wherein the switch-off projection is configured to yield resiliently such that the switch-off projection is bent for contact with the housing stop on the one-sided open housing when loaded with a predefinable first force which acts in a direction of the manual operating part and parallel to the rotation axis of the rotatable shaft.

2. The operating attachment according to claim 1, wherein the switch-off projection is connected with the rotatable shaft by a connecting region, and wherein the connecting region is configured accordingly in a resiliently yielding manner.

3. The operating attachment according to claim 1, wherein the switch-off projection comprises a plastic.

4. The operating attachment according to claim 1, wherein the predefinable bending of the switch-off projection is reversible.

5. The operating attachment according to claim 1, wherein the switch-off projection comprises a switching device toggle operating range, and the switching device toggle operating range is formed transversely so as to generate the first force when the pivotable switching device toggle is operated.

6. The operating attachment according to claim 1, wherein the switch-off projection and the switch-on projection are integrally formed.

7. The operating attachment according to claim 1, wherein the manual operating part comprises a rotary knob.

8. A system, comprising:

the predefinable switching device according to claim 1 comprising a protective switch or a load-break switch; and the operating attachment according to claim 1.

* * * * *